US011306479B2

(12) United States Patent
Sareyka et al.

(10) Patent No.: US 11,306,479 B2
(45) **Date of Patent: *Apr. 19, 2022**

(54) MULTI-DIRECTIONAL BEAM FOR A DRYWALL CEILING SOFFIT RELATED APPLICATION

(71) Applicant: Worthington Armstrong Venture, Malvern, PA (US)

(72) Inventors: Brett W. Sareyka, Glen Mills, PA (US); Yu Lin, Blue Bell, PA (US); Jeff Markley, Middle River, MD (US); Jason Robbins, East Earl, PA (US); Sebastien Place, Chester Springs, PA (US); Joshua L. Neal, Phoenixville, PA (US)

(73) Assignee: Worthington Armstrong Venture, Malvern, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/998,442

(22) Filed: Aug. 20, 2020

(65) Prior Publication Data

US 2020/0378115 A1 Dec. 3, 2020

Related U.S. Application Data

(63) Continuation of application No. 16/536,407, filed on Aug. 9, 2019, now Pat. No. 10,760,268.
(Continued)

(51) Int. Cl.
*E04B 9/06* (2006.01)
*E04B 9/04* (2006.01)

(52) U.S. Cl.
CPC ..... *E04B 9/06* (2013.01); *E04B 9/04* (2013.01); *E04B 9/061* (2013.01); *E04B 9/068* (2013.01)

(58) Field of Classification Search
CPC . E04B 9/06; E04B 9/068; E04B 9/061; E04B 9/04
(Continued)

(56) References Cited

U.S. PATENT DOCUMENTS 3,388,519 A 6/1968 Downing, Jr.
3,457,688 A 7/1969 Znamirowski
(Continued)

FOREIGN PATENT DOCUMENTS

GB 1143283 2/1969
GB 1380574 1/1975
(Continued)

*Primary Examiner* — Adriana Figueroa
(74) *Attorney, Agent, or Firm* — Stradley Ronon Stevens & Young, LLP

(57) ABSTRACT

A straight beam made for use in a suspended horizontal drywall ceiling. The beam is modified so that it can be bent in multiple directions to multiple predetermined angles. The beam has a web connecting two top flanges to two bottom flanges. A notch in the web extends through either the top or bottom flanges dividing the beam into a first side and a second side. The first side and the second side may each contain a pocket angled away from an outward face of the web forming a cutout having a locking edge and optionally a protuberance projecting out in the same direction as the pocket. Furthermore, the first side and the second side may optionally each contain an indentation projecting outward from the web in a direction opposite the spring pocket. As a result, when the beam is bent to the desired predetermined angle the locking edge or indentation may engage with the protuberance locking the angle in place. A soffit may then be constructed with drywall hung therefrom.

17 Claims, 18 Drawing Sheets

Related U.S. Application Data

(60) Provisional application No. 62/717,076, filed on Aug. 10, 2018.

(58) Field of Classification Search
USPC ..... 52/506.07
See application file for complete search history.

(56) References Cited

U.S. PATENT DOCUMENTS 3,846,031 A 11/1974 Adams
3,922,829 A 12/1975 Sauer
3,965,632 A 6/1976 Rousey
4,128,978 A * 12/1978 Beynon ..... E04B 9/068 52/232
4,317,641 A 3/1982 Sauer
4,531,340 A 7/1985 Sauer
4,628,582 A * 12/1986 Leopold ..... E06B 3/667 118/676
4,685,262 A 8/1987 Meredith, Jr.
4,783,946 A * 11/1988 Boegle ..... E04B 9/065 52/506.1
4,785,595 A 11/1988 Dunn
6,722,098 B2 4/2004 Platt
6,751,922 B1 * 6/2004 Auriemma ..... E04B 9/068 52/506.05
7,669,374 B2 * 3/2010 Miller ..... E04B 9/061 52/506.07
7,997,037 B2 * 8/2011 Crandell ..... E06B 3/6604 52/204.593
8,869,484 B2 * 10/2014 Gulbrandsen ..... E04B 9/061 52/506.07
2008/0215018 A1 10/2008 Miller

FOREIGN PATENT DOCUMENTS

GB 1424798 2/1975
WO 8505391 12/1985

* cited by examiner

MULTI-DIRECTIONAL BEAM FOR A DRYWALL CEILING SOFFIT RELATED APPLICATION

RELATED APPLICATION

This application is a continuation of U.S. application Ser. No. 16/536,407, filed on Aug. 9, 2019, which claims the benefit of priority to U.S. Provisional Patent Application Ser. No. 62/717,076, filed on Aug. 10, 2018, all the contents of which are incorporated in this application by reference.

FIELD OF THE INVENTION

This disclosure relates generally to the field of beams that are roll-formed from sheet metal and that comprise the grid of suspended ceilings and, more specifically, beams that can be bent and locked into multiple directions to assist in the creation of ceiling soffits.

BACKGROUND OF THE DISCLOSURE

Beams used in suspended drywall ceilings are well known. In such ceilings, beams are suspended by hanger wires from a structural ceiling, and sheets of drywall are secured to the suspended beams by self-tapping screws.

The beams are made by continuously roll-forming a strip of metal to fold the strip longitudinally into an inverted T cross section, with a bulb at the top, a web extending down from the bulb, and two flanges extending horizontally opposite from one another at the lower end of the web. The flanges have indentations or holes in their lower surface that capture self-tapping screws to permit the screws to penetrate the flange after passing through the drywall sheet.

Such a beam is shown, for instance, in U.S. Pat. No. 6,722,098, for Beam for Drywall Ceiling, incorporated herein by reference.

Suspended drywall ceilings generally extend horizontally. Occasionally, a ceiling soffit in the form of an underhang, having a two-dimensional cross-section, is formed. The drywall ceiling soffit may be made with the same kind of beams and drywall sheets used in a horizontal drywall suspended ceiling. In forming the soffit, straight beams of the kind used in such horizontal drywall suspended ceiling are individually cut and bent (i.e., the flange provides the pivot point while the web and bulb material are cut and/or removed). The bent beams may then be fastened together by drilling holes and inserting fastening screws. Conversely, the beams may be fastened together by removing a v-shaped section of the bulb and/or web material, bending the beam, and then securing the bend with a clip and fasteners. Furthermore, the beam may be straight cut into two segments, which may then be fastened together with a clip.

A plurality of beams bent in multiple directions is then used to form a beam framework for the soffit. Such work in the field is time-consuming, and often non-uniform, so that the parts do not easily fit together.

Unlike a flange that remains substantially planar when subject to bending forces, a bulb typically deforms resulting in a surface that is not substantially flat (i.e., planar). As a result, absent the use of additional hardware (e.g., a clip), a beam including a bulb may only be bent in at most a single direction.

Therefore, there exists a need for a roll-formed beam that includes pivot points on at least the top and bottom of the beam to permit contractors to form numerous shapes such as zig-zags, chicanes, question-marks, or channels with all such shapes formed with a single beam. Furthermore, such a beam may also contain an automatic locking mechanism(s), which may save time and result in uniform soffit creation.

BRIEF SUMMARY OF THE DISCLOSURE

To meet this and other needs, and in view of its purposes, an i-shaped roll-formed beam with alternating top and bottom web notches is provided. In one embodiment, this beam includes an automatic locking mechanism.

The disclosed beam includes a web having a first edge opposite a second edge. Two first flanges are opposite one another at the first edge and extend substantially perpendicularly out from the web. Two second flanges are opposite one another at the second edge and again extend substantially perpendicularly out from the web. The web includes a web notch beginning in the web and extending through either the first flanges or the second flanges. The web notch has a first side and a second side. Both the first side and the second side may include a spring pocket angled away from an outward face of the web. In certain embodiments in which both the first side and the second side include spring pockets, the spring pockets will be angled away from opposite faces of the web. The spring pocket defines a cutout which may serve as a locking edge.

In one embodiment, the first side and second side are not in the same plane. Such an embodiment may permit the first side and second side to more easily engage with each other when the beam is bent.

In another embodiment, both the first side and the second side may include an indentation and protuberance forming a locking edge adapted to engage (e.g., lock) with the indentation when the beam is bent to a predetermined angle. In one embodiment the first side or the second side has two or more cutouts or protuberances adapted to engage (e.g., lock) with the indentation when the beam is bent to different predetermined angles. In one embodiment, the indentation projects in a direction opposite the spring pocket. In another embodiment, the protuberance projects in the same direction as the spring pocket.

In a further embodiment, both the first side and the second side include an indentation adapted to engage (e.g., lock) with the cutout formed by the spring pocket when the beam is bent to a predetermined angle.

In other non-limiting embodiments, the web notch passes through either the first flanges, the second flanges, or alternates between passing through the first flanges and the second flanges. Furthermore, the web notches may be equally spaced with any number of alternating patterns (e.g., 2-1-2, 1-2-1, 2-2-2, etc.). In another embodiment, the web notches will not be equally spaced, however, they may still include any number of alternating patterns.

In another embodiment, the first side and the second side may each include a tongue extended outward in a direction away from the spring pocket. The tongue may assist in guiding the opposite side and/or the indentation towards the spring pocket and cutout.

In another embodiment, the first side and second side are not in the same plane as each other. For example, the first side may be offset from the web and second side. Conversely, the second side may be offset from the web and first side. Indeed, the first side may be offset from the web, which itself may be offset from the second side (i.e., the first side, web, and second side may all reside in different planes). Such displacement may be accomplished by mechanical forces that may result in web displacement. Such displacement may assist in guiding the first side, second side, and/or an indentation towards the opposite spring pocket and cutout.

In a further embodiment, the first side, the second side, and/or both sides have an aperture adapted to accept fasteners. The inclusion of such fasteners may assist in locking the beam into a predetermined angle such as about 15°, about 30°, about 45°, about 60°, about 75°, about 90°, about 105°, about 120°, about 135°, about 150°, or about 165°.

In another embodiment the first flanges, the second flanges, or both include flange notches. Such flange notches may be substantially perpendicular to the web notch and may decrease the potential for deformation of the flanges as the beam is bent to the desired predetermined angle(s).

In another embodiment the first flanges, the second flanges, or both include a bend line. Such bend lines may be substantially perpendicular to the web notch ensuring the deformation of the flange remains substantially perpendicular to the web as the beam is bent to the desired predetermined angle(s). Such bend lines may be created by subjecting the beam to bending forces during manufacture.

In a further non-limiting embodiment, the first flanges or the second flanges are textured or include apertures adapted to accept fasteners. Such fasteners may be used to secure drywall to the beam.

The beam may also be incorporated into a ceiling system to assist in manufacturing a soffit. The beam may also be made of steel.

It is to be understood that both the foregoing general description and the following detailed description are exemplary, but are not restrictive, of the invention.

BRIEF SUMMARY OF THE SEVERAL VIEWS OF THE DRAWING

The invention is best understood from the following detailed description when read in connection with the accompanying drawing and appended claims. It is emphasized that, according to common practice, the various features of the drawing are not to scale. On the contrary, the dimensions of the various features are arbitrarily expanded or reduced for clarity. Included in the drawing are the following figures:

DETAILED DESCRIPTION

Figure 1A:
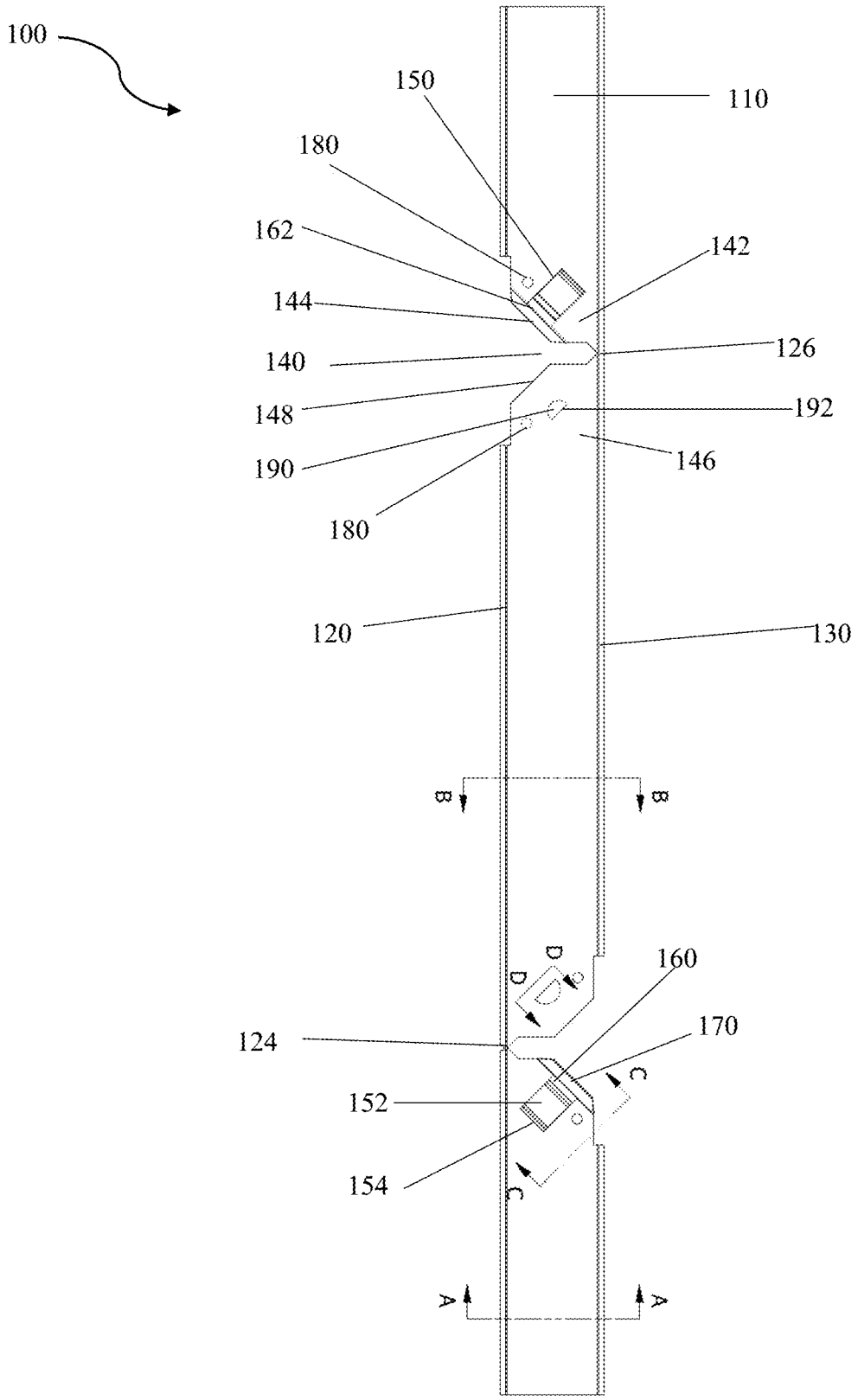
FIG. 1A is a side view of one embodiment of a multi-directional beam for a drywall ceiling soffit.

The features and benefits of the disclosed beam are illustrated and described by reference to exemplary embodiments. The disclosure also includes the drawing, in which like reference numbers refer to like elements throughout the various figures that comprise the drawing. This description of exemplary embodiments is intended to be read in connection with the accompanying drawing, which is to be considered part of the entire written description. Accordingly, the disclosure expressly should not be limited to such exemplary embodiments illustrating some possible non-limiting combination of features that may exist alone or in other combinations of features.

In the description of embodiments, any reference to direction or orientation is merely intended for convenience of description and is not intended in any way to limit the scope of the present invention. Relative terms such as "lower," "upper," "horizontal," "vertical," "above," "below," "up," "down," "top," and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be construed or operated in a particular orientation. Terms such as "attached," "affixed," "connected," "coupled," "interconnected," and similar terms, refer to a relationship wherein structures are secured or attached to one another either directly or indirectly through intervening structures, as well as both moveable or rigid attachments or relationships, unless expressly described otherwise.

The present invention provides a beam that does not just bend (purposefully) in a single direction. Indeed, the beam may be bent in at least two different directions permitting a single beam to be formed into numerous desired shapes such as a z-shaped, zig-zag, chicane, or u-shaped channel. Current, soffit solutions only permit beams to be bent in at most a single direction. As a result, without the incorporation of additional hardware, these single-directional beams may only form, at best, a u-shaped channel. Conversely, the disclosed beam may be bent in two or more directions.

Beam Structure

Figure 1B:
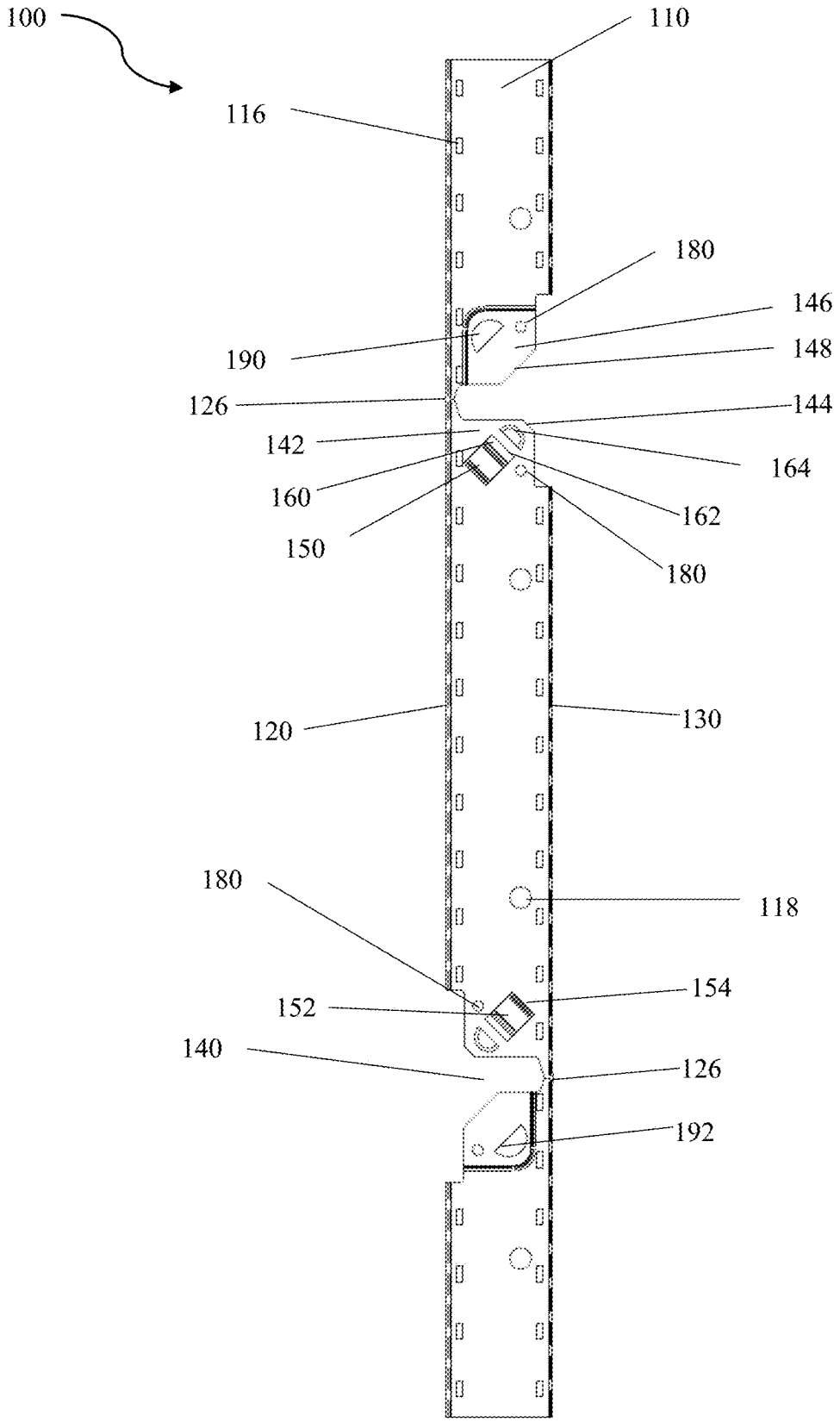
FIG. 1B is a side view of a second embodiment of a multi-directional beam for a drywall ceiling soffit.
Figure 1C:
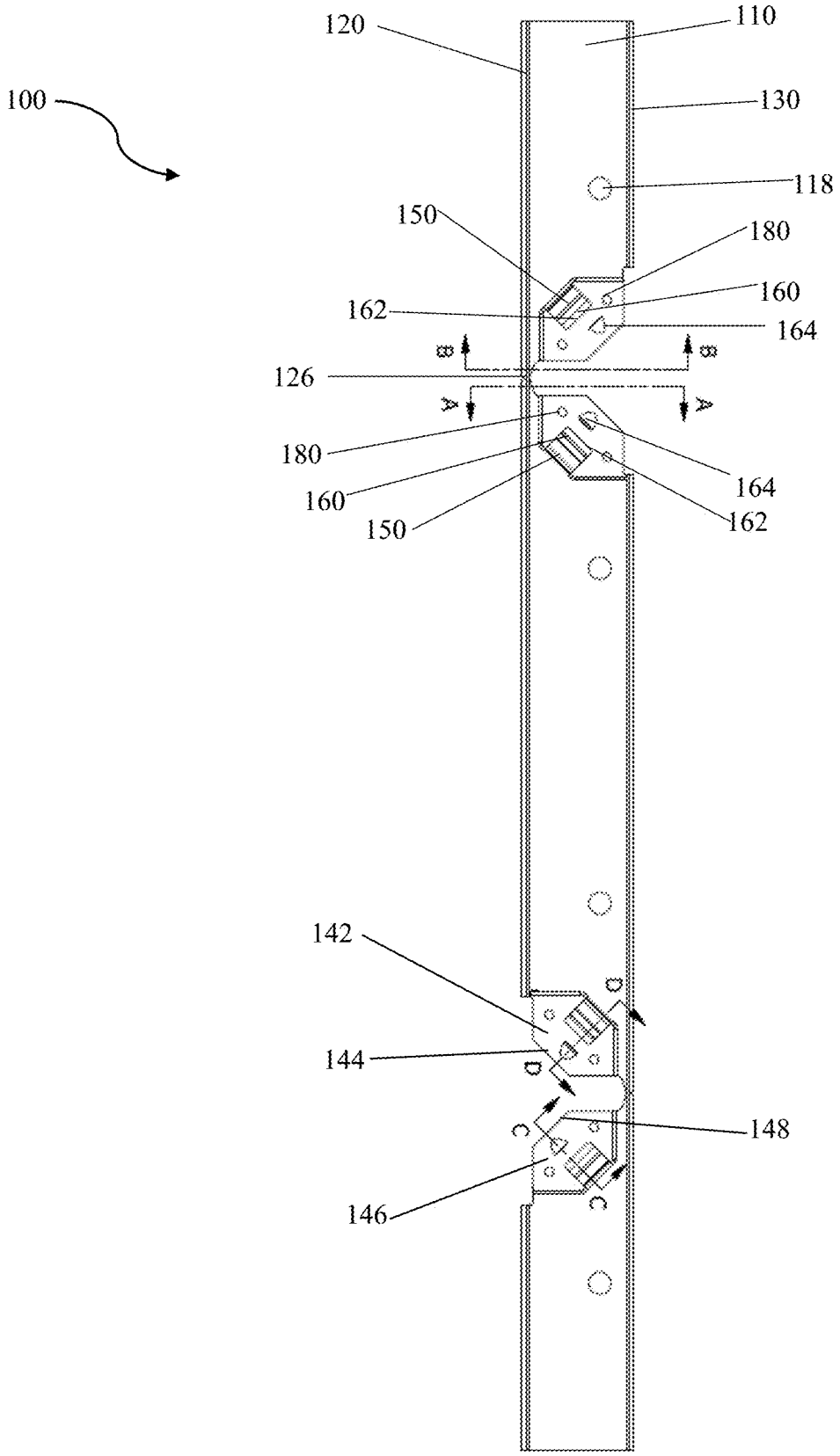
FIG. 1C is a side view of a third embodiment of a multi-directional beam for a drywall ceiling soffit
Figure 2A:
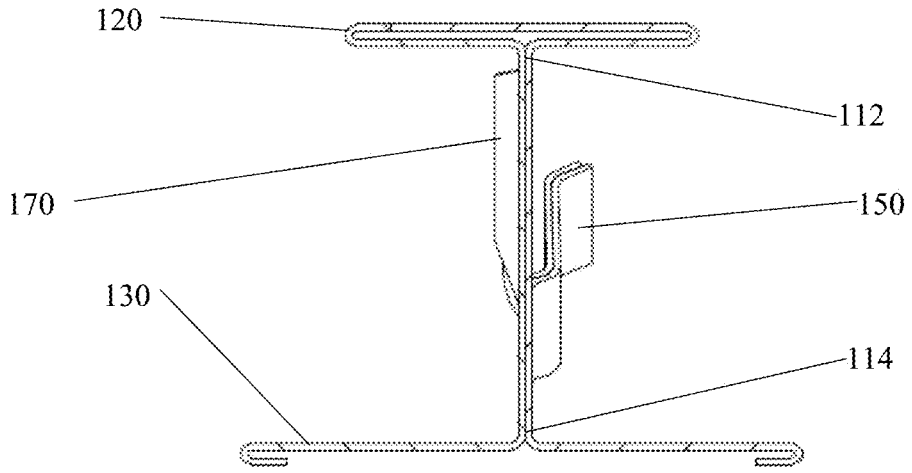
FIG. 2A is a front sectional view taken on the line A-A of FIG. 1A.
Figure 2B:
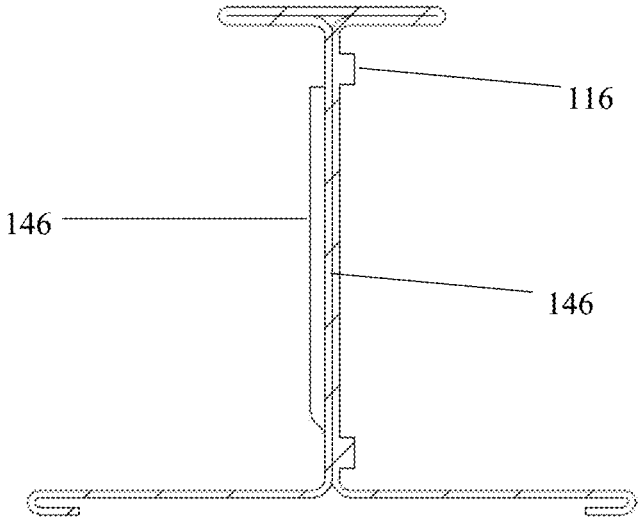
FIG. 2B is a front sectional view of FIG. 1B.
Figure 2C:
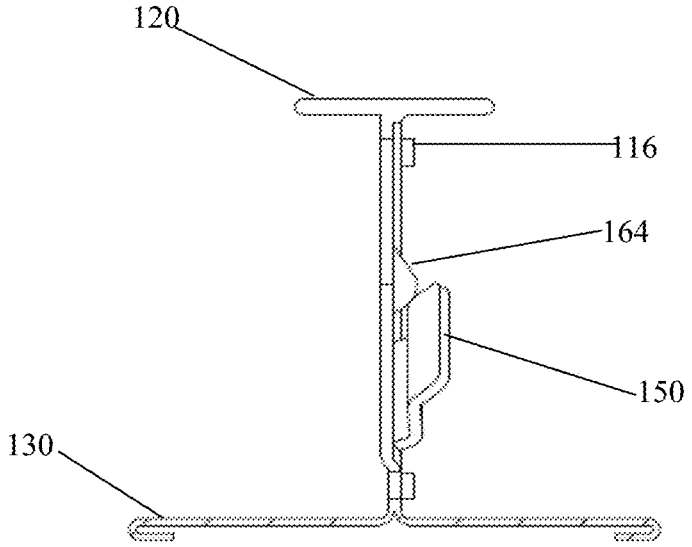
FIG. 2C is a front sectional view taken on the line A-A of FIG. 1C.
Figure 3A:
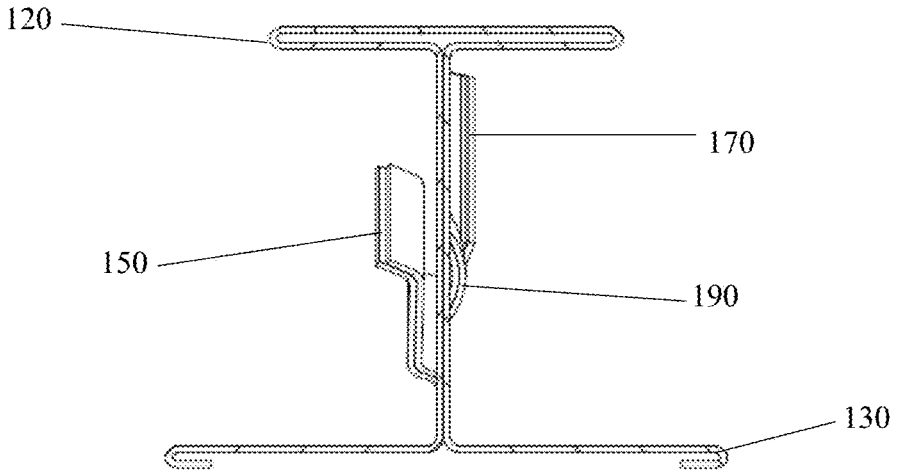
FIG. 3A is a rear sectional view taken on the line B-B of FIG. 1A.
Figure 3B:
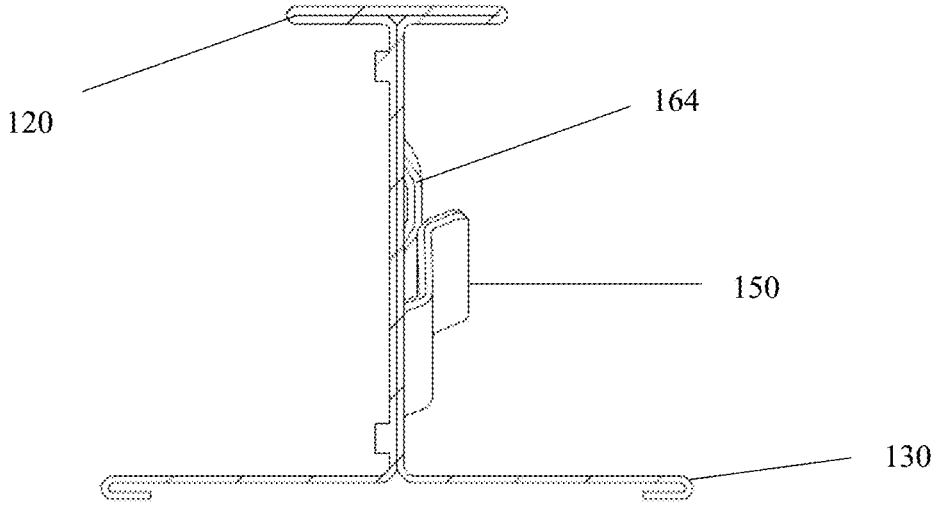
FIG. 3B is a rear sectional view of FIG. 1B.
Figure 3C:
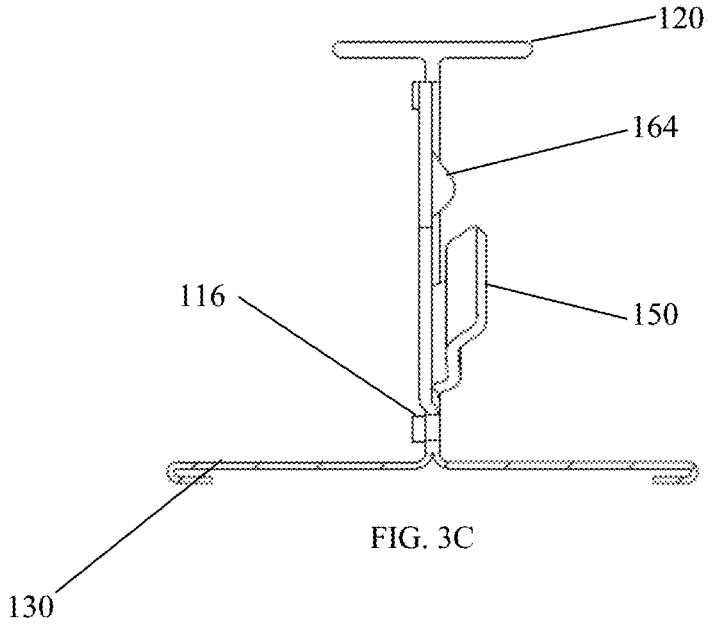
FIG. 3C is a rear sectional view taken on the line B-B of FIG. 1C.
Figure 4A:
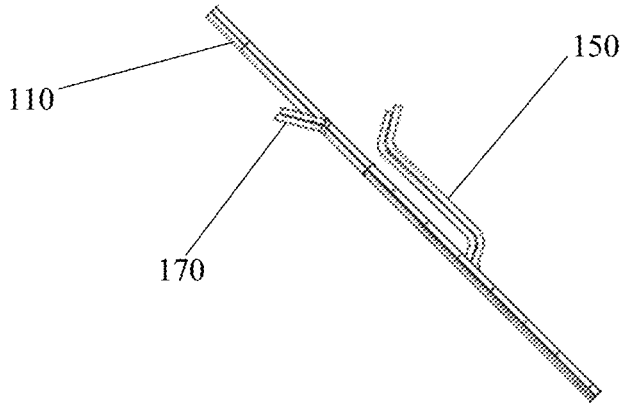
FIG. 4A is an angled sectional view taken on the line C-C of FIG. 1A.
Figure 4B:
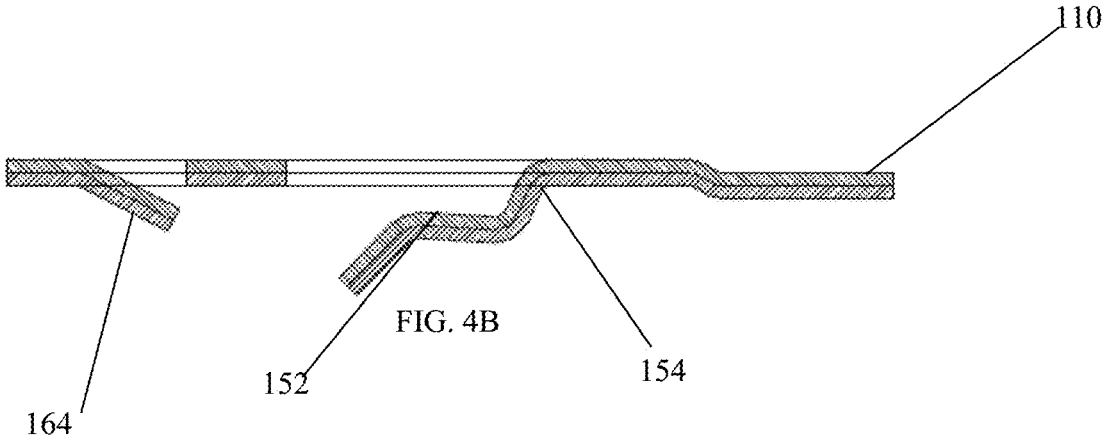
FIG. 4B is an angled sectional view taken on the line of C-C of FIG. 1C.
Figure 5A:
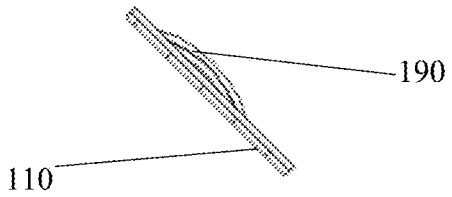
FIG. 5A is an angled sectional view taken on the line D-D of FIG. 1A.
Figure 5B:
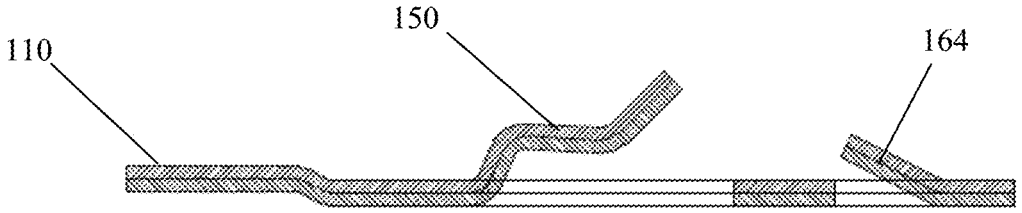
FIG. 5B is an angled sectional view taken on the line D-D of FIG. 1C.
Figure 6A:
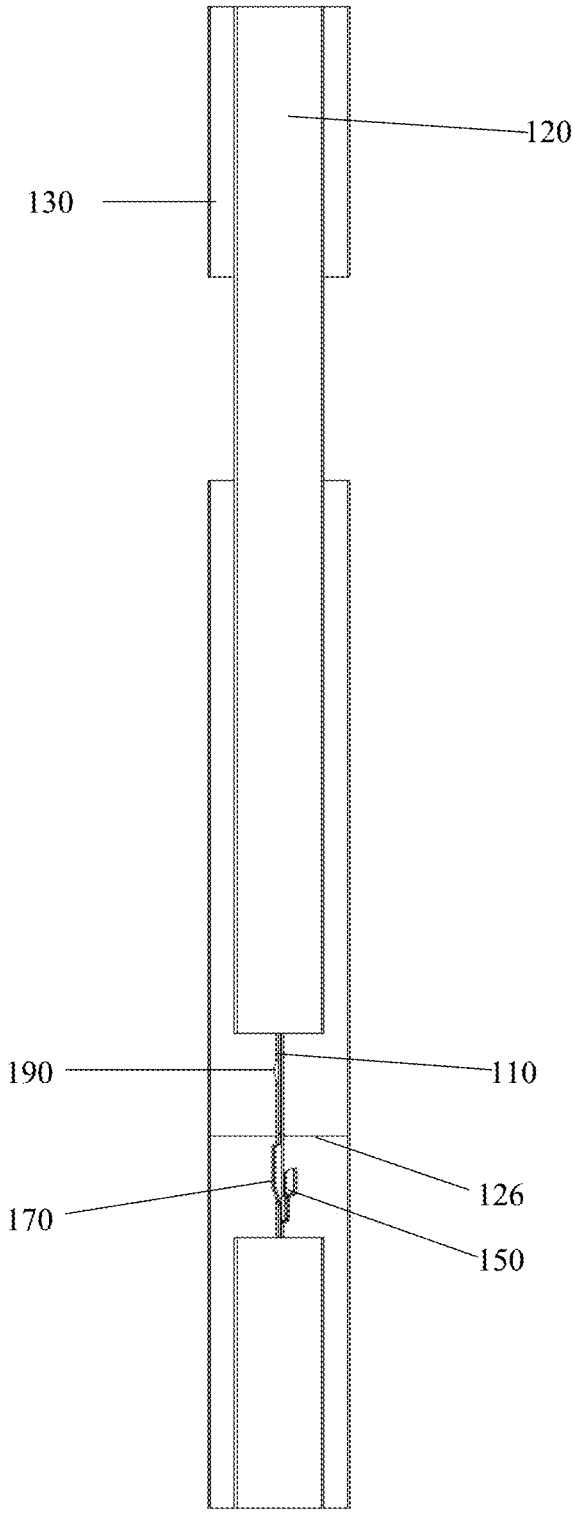
FIG. 6A is a top view of the multi-directional beam for a drywall ceiling soffit shown in FIG. 1A.
Figure 6B:
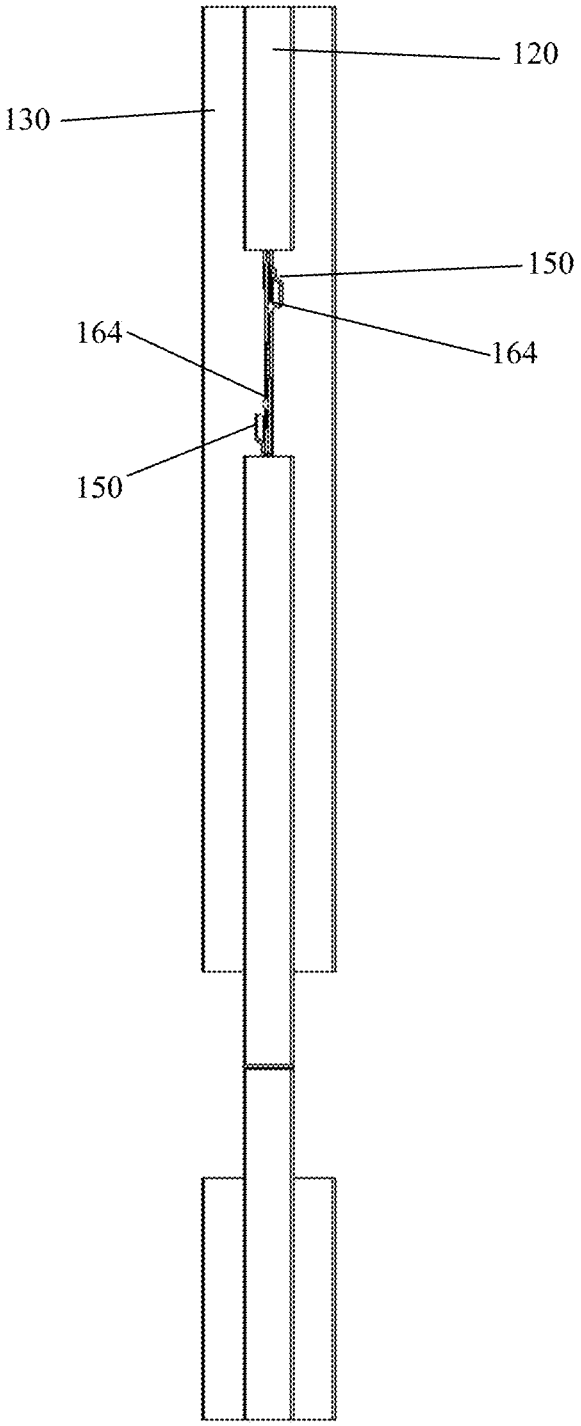
FIG. 6B is a top view of the multi-directional beam for a drywall ceiling soffit shown in FIG. 1C.
Figure 7A:
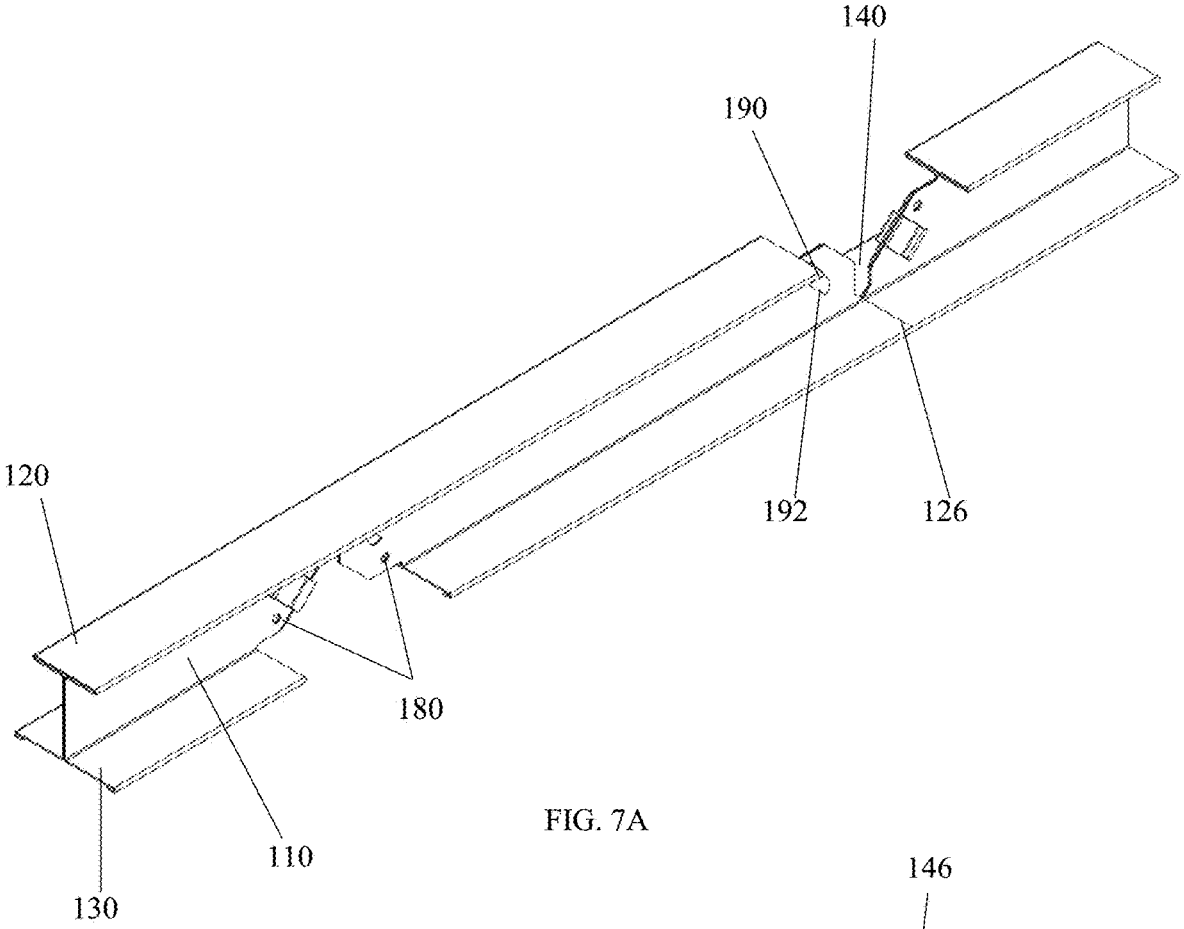
FIG. 7A is a perspective view of the multi-directional beam for a drywall ceiling soffit shown in FIG. 1A.
Figure 7B:
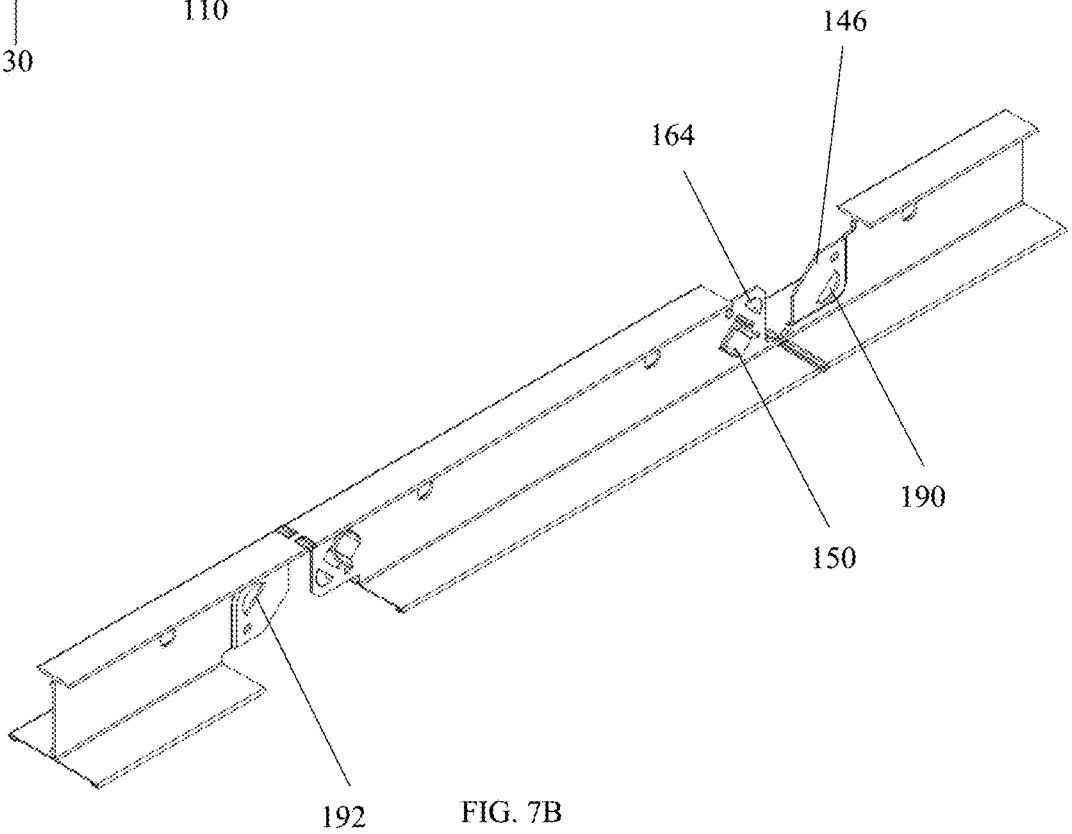
FIG. 7B is a perspective view of the multi-directional beam for a drywall ceiling soffit shown in FIG. 1B.
Figure 7C:
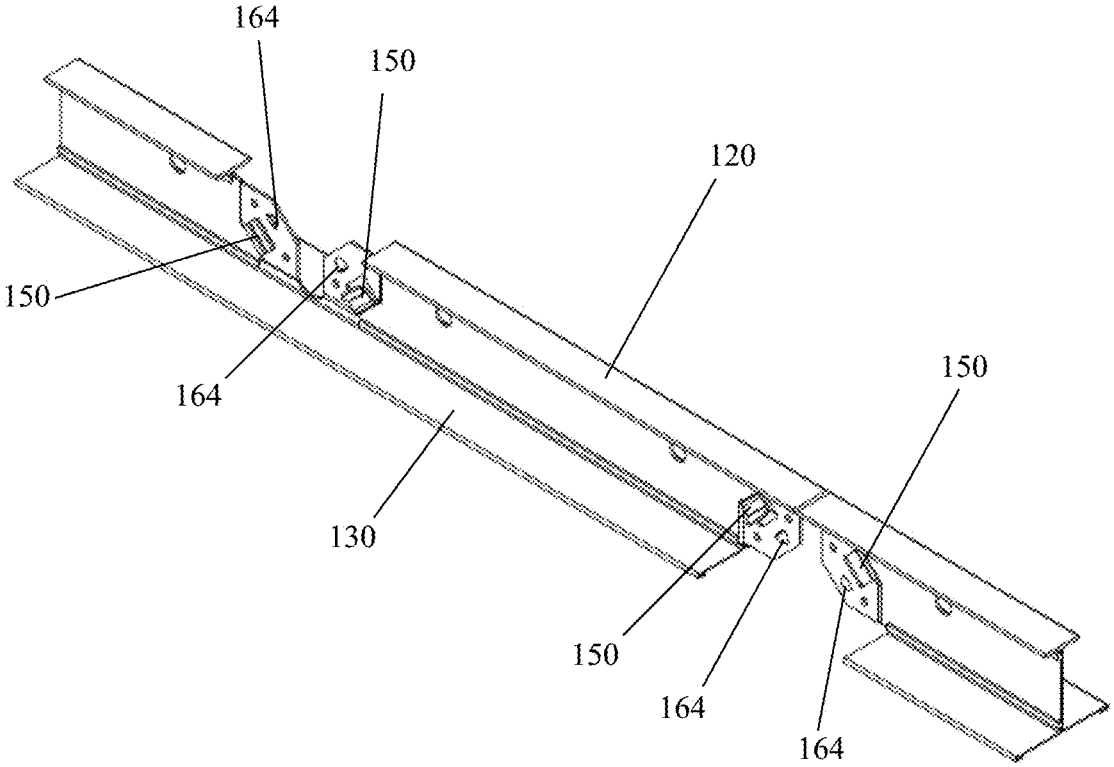
FIG. 7C is a perspective view of the multi-directional beam for a drywall ceiling soffit shown in FIG. 1C.
Figure 8:
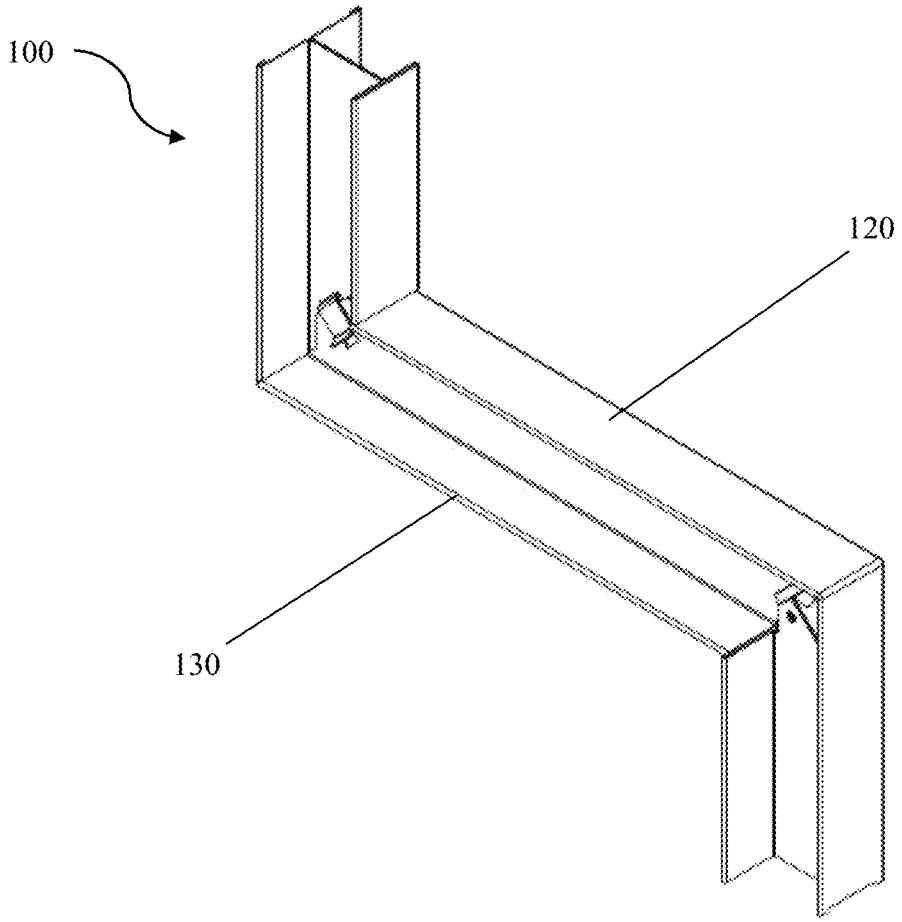
FIG. 8 is a perspective view of FIG. 1A in the bent position.
Figure 9A:
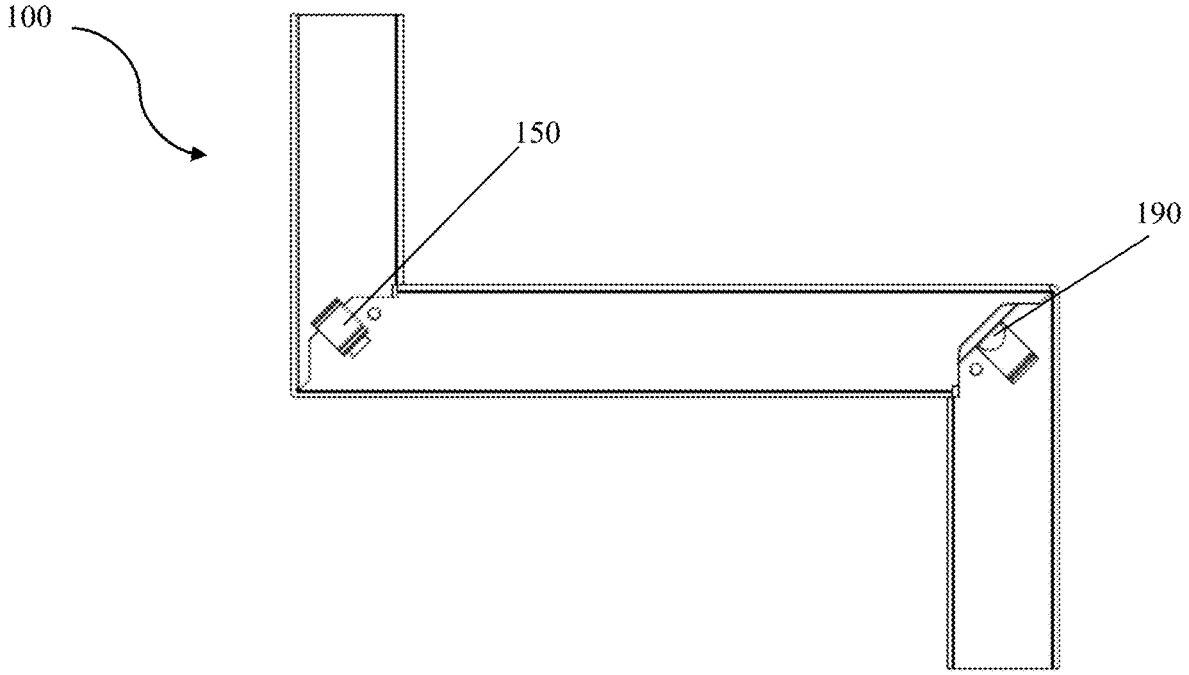
FIG. 9A is a front view of the multi-directional beam for a drywall ceiling soffit shown in FIG. 8.
Figure 9B:
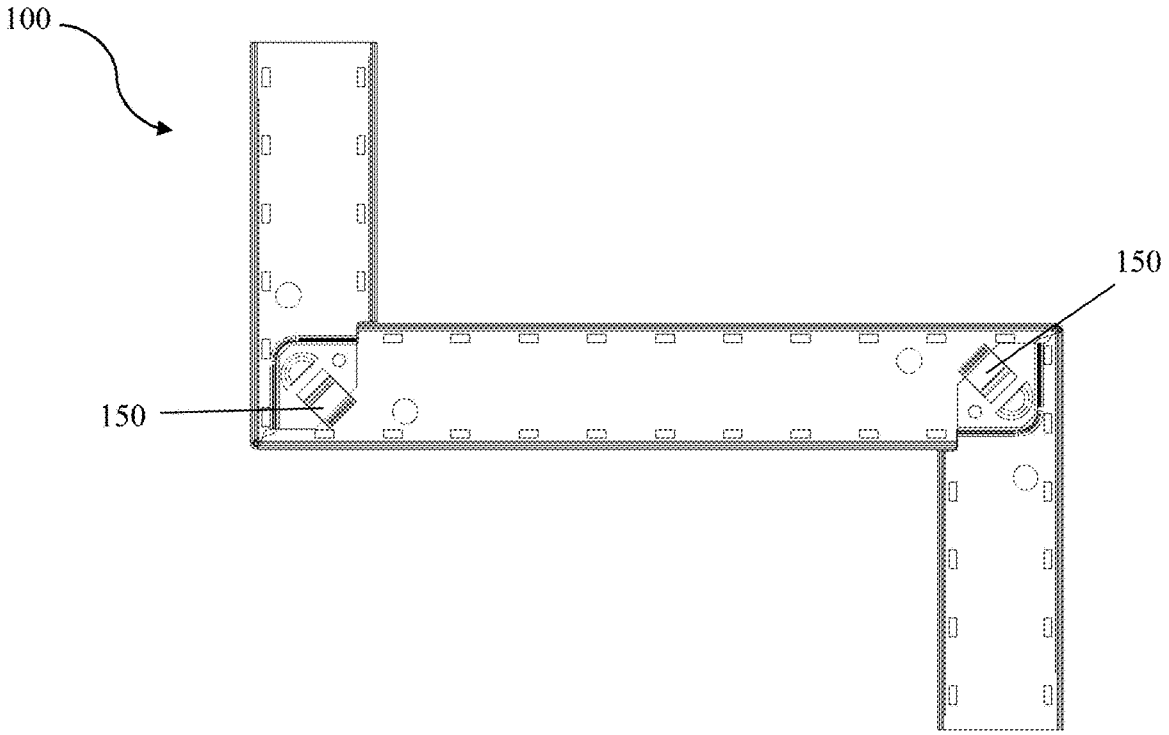
FIG. 9B is a front view of the multi-directional beam for a drywall ceiling soffit shown in FIG. 1B.
Figure 9C:
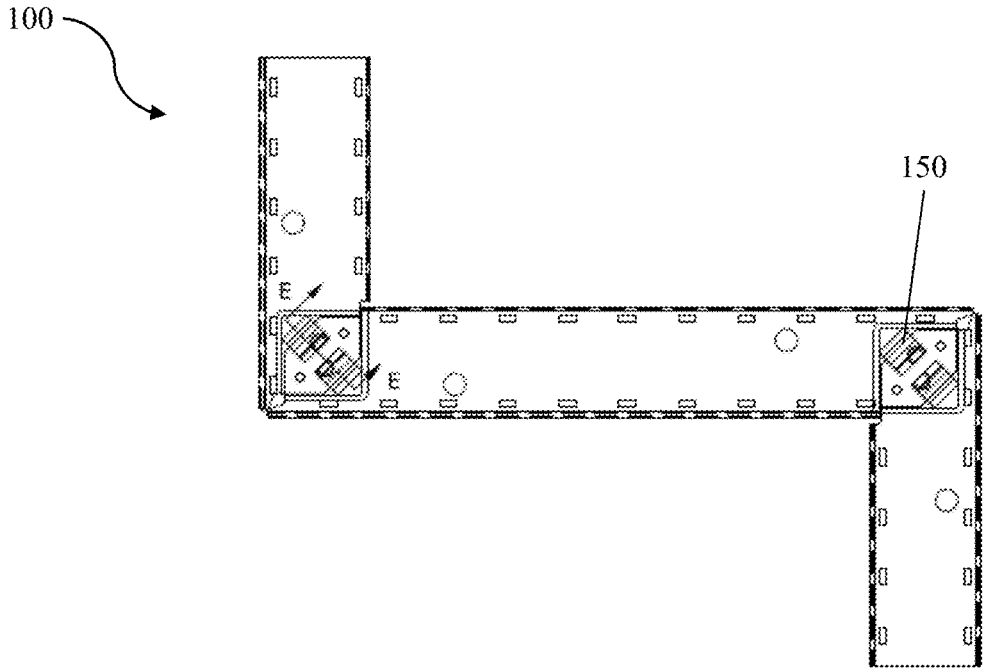
FIG. 9C is a front view of the multi-directional beam for a drywall ceiling soffit shown in FIG. 1C.
Figure 10A:
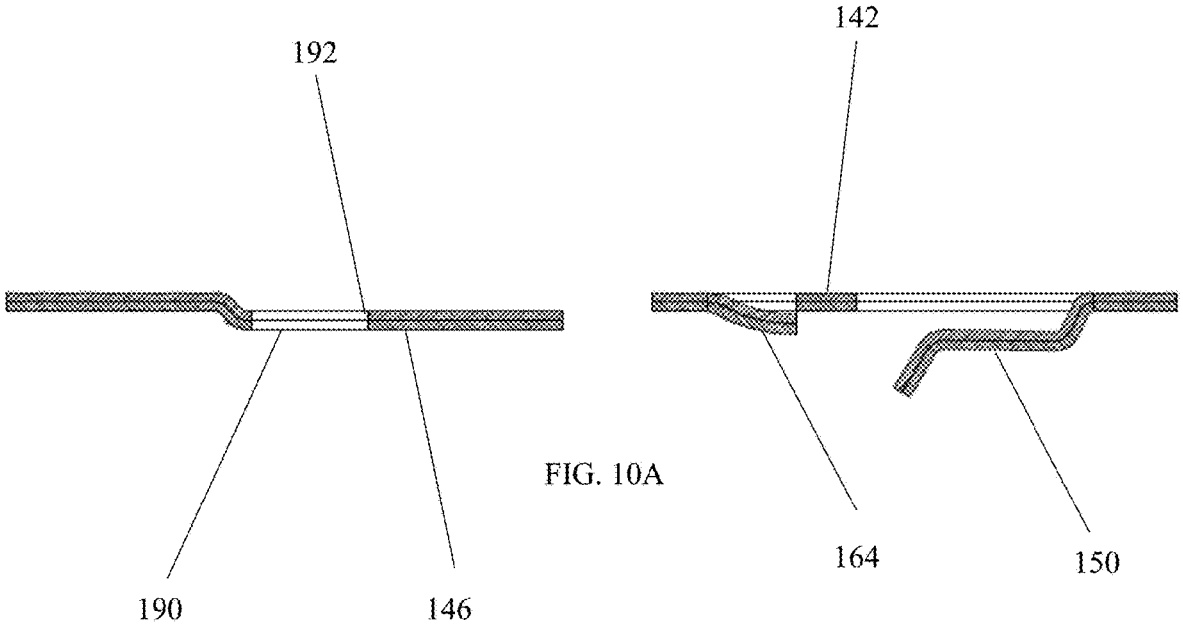
FIG. 10A is a top sectional view of the first side and second side of the web notch of FIG. 1B wherein the first side and second side are not engaged with each other.
Figure 10B:
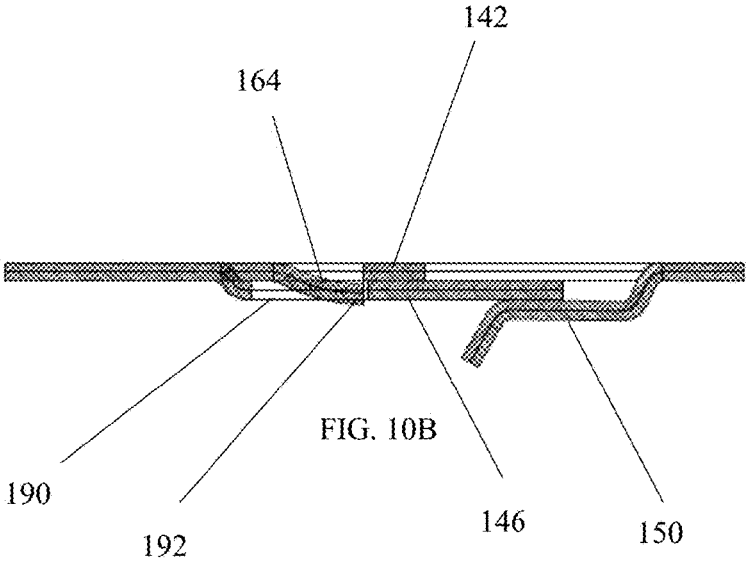
FIG. 10B is a top sectional view of the first side and second side of the web notch of FIG. 1B wherein the first side and second side are engaged with each other.
Figure 10C:
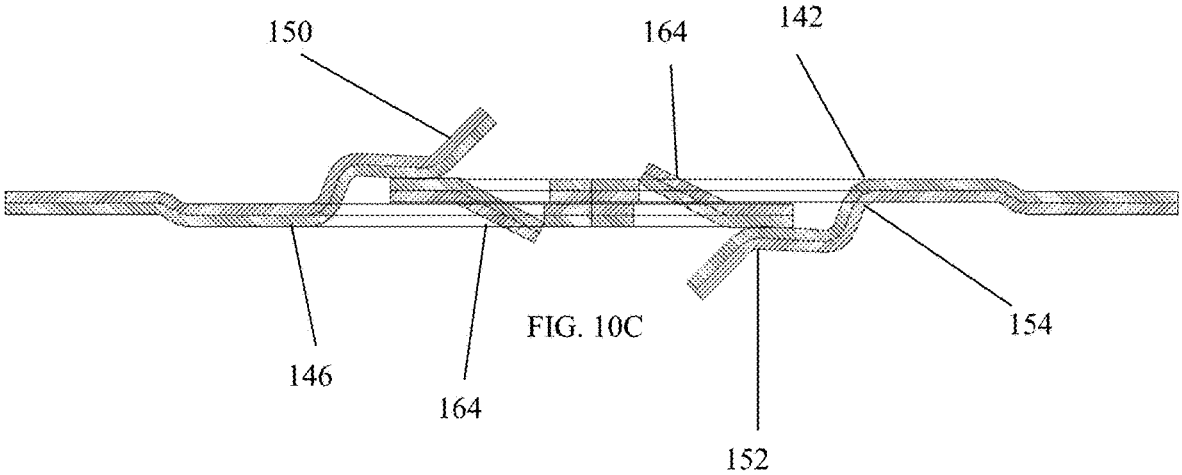
FIG. 10C is front sectional view taken on the line E-E of FIG. 9C

FIGS. 1A, 1, and 1C depict exemplary embodiments of the beam 100. The beam 100 is in the shape of an I-beam, with a web 110, which has a first side 112 and a second side 114 opposite the first side 112, and connects a first set of flanges 120 to a second set of flanges 130. Both the first flanges 120 and the second flanges 130 extend opposite each other and substantially perpendicularly out from opposite faces of the web 110. The first flanges 120 are connected to the web 110 at the first side 112, and the second flanges 130 are connected to the web 110 at the second side 114.

Web

The web 110 also has web notches 140 which may be repetitively spaced and/or alternating between extending through the web 110 and either the first flanges 120 or the second flanges 130. In an exemplary embodiment, the web 110 may be comprised of two sheets of metal joined with a stitch 116. The sheets may comprise two surfaces opposite one another. The first surface is stitched to the second surface by forcing a portion of the first surface through a portion of the second surface creating a protuberance in the second surface. It is further understood that the web 110 may be comprised of a single sheet or multiple sheets (e.g., two, three, or four sheets) of material. Regardless of construction the web 110 will have a first face opposite a second face.

In one embodiment, the web 110 includes holes 118 that pass entirely through the web 110. Such holes 118 may assist an installer is securing the beam 100 to a structure.

Flanges

In a non-limiting embodiment, the first flanges 120 and the second flanges 130 are connected to opposite ends of the web 110. Furthermore, the first flanges 120 and the second flanges 130 may be substantially parallel to each other.

In an exemplary embodiment, a cap may be added to one or both of the first flange 120 or the second flange 130. The cap may be wrapped around the edges of the flanges 120, 130 opposite the web 110. Such a cap may provide additional structural support.

In another embodiment, one or both of the first flanges 120 and second flanges 130 may be textured or have holes which pass entirely through the flanges 120, 130. Such texturing and/or holes may assist in fastening drywall to the flanges 120, 130.

In a further embodiment, flange notches 124 may be included in either the first flanges 120 and/or the second flanges 130. Such flange notches 124 may decrease the longitudinal deformation of the flanges 120, 130 during bending.

In a non-limiting embodiment, bend lines may be included in either the first flanges 120 and/or the second flanges 130. Such bend lines may be the result of the beam 100 being subjected to bending forces during manufacture.

Web Notch

Each web notch 140 has a first side 142, having a first edge 144, across from a second side 146, having a second edge 148.

In certain embodiments, the first side 142 and the second side 146 may each contain a spring pocket 150 defining a cutout 160, which is a hole in either the first side 142, the second side 146, or both sides. In certain embodiments, both first side 142 and the second side 146 each contain spring pockets 150. In such a configuration, the spring pockets 150 project outward from opposite faces of the web 110. Thus, permitting each spring pocket 150 to engage an opposite face of the web 110.

In certain embodiments, the first side 142 and the second side 146 may optionally each contain a tongue 170, a protuberance 164 projecting in the direction of the pocket 150, at least one aperture 180 adapted to accept a fastener, or an indentation 190 projecting in the direction opposite the pocket 150. In one embodiment, the indentation 190 may be a cutout adapted to engage (e.g., lock) with the protuberance 164 at predetermined angles.

Although the spring pocket 150 is formed from the web 110, the pocket 150 is angled away from an outward face of the web 110, leaving the cutout 160. The pocket 150 is connected to the web 110 by a portion 152 furthest from both the first edge 144 and the second edge 148. In certain embodiments, the spring pocket 150 folds back toward the closest outward face of the web 110. The pocket 150 is then joined to the closest outward face of the web 110 at a fold line 154.

In one embodiment, the cutout 160 has at least one locking edge 162 closest to the first edge 144, or second edge 148. In one embodiment, the locking edge 162 may be curved. In another embodiment, the locking edge 162 may be substantially flat. The cutout 160 may also have additional edges that are straight or curved. In a further embodiment, the locking edge 162 is substantially parallel to either the first edge 144 or the second edge 148.

In certain embodiments, the spring pocket 150 is adapted to apply a spring force onto the opposite side 142 or 146 in the direction of the web 110 to assist in holding the beam 100 at the predetermined angle. In applying such a spring force, the spring pocket 150 may initially projects in a direction away from the web 110 and then bends back to project in a direction either parallel to or back towards the web 110.

In other embodiments, the spring pocket 150 may include a second bend resulting in a terminal end of the spring pocket 150 projecting away from the web 110. Such a second bend may assist in guiding opposite side 142 or 146 towards engagement with the spring pocket 150.

In one embodiment, the first side 142 and the second side 146 are not in the same plane. For example, the first side 142 may be offset from the web 110, and second side 146. Conversely, the second side 146 may be offset from the web 110 and first side 142. Indeed, the first side 142 may be offset from the web 110, which itself may be offset from the second side 146 (i.e., the first side 142, web 110, and second side 146 may all reside in different planes).

In one non-limiting embodiment, the tongue 170 projects out from the first side 142 or the second side 146 in a direction opposite the pocket 150. Indeed, the first edge 144 or the second edge 148 may be a part of the tongue 170. The tongue 170 may be further adapted to guide the opposite edge 144 or 148 and/or the indentation 190 towards the cutout 160 as the beam 110 is rotated about a pivot point 126.

The first side 142 and the second side 146 may each contain at least one aperture 180. Each aperture 180 may be adapted to accept a fastener. Furthermore, the apertures 180 may be positioned so that the apertures 180 will align at different angles. For example, an aperture 180 on the first side 142 may align with one aperture 180 on the second side 146 when the beam 100 is bent to 30°. The aperture 180 on the first side 142 may further align with another aperture 180 on the second side 146 when the beam 100 is bent to 60°.

The first side 142 and the second side 146 may each include the indentation 190, which projects in a direction opposite the pocket 150. Indeed, the indentation 190 may be adapted to engage with the cutout 160 so as to prevent the angle of the beam 100 from further advancing or coming apart. In a non-limiting embodiment, the indentation 190 may include a flat edge 192 adapted to engage with the locking edge 162 of the cutout 160. Conversely, in other embodiments where the first side includes a protuberance 164, the indentation 190 may form a cutout (e.g., the indenture 190 may be removed). In such an embodiment, the indentation 190 may be adapted to engage with the protuberance 164 so as to prevent the angle of the beam 100 from further advancing or coming apart. In a non-limiting embodiment, the protuberance 164 indentation may include a flat edge adapted to engage with a flat edge 192 of the indentation 190.

Pivot Point Spacing

The pivot points 126 on the beam 100 may be spaced repetitively. Such spacing may be at equal distances. Indeed, the pivot points 126 may be spaced at specified intervals from other pivot points. For example, the pivot points 126 located on the first flanges 120 may be one foot (0.3 m) in each direction from the pivot points 126 located on the second flange 130, which are themselves located one foot (0.3 m) in each direction from the pivot points 126 located on the first flange 120. In this way, alternating top and bottom pivot points 126 are located every foot (0.3 m).

Furthermore, the distance is not restricted to one foot (0.3 m). Indeed, the distance may be anywhere between about 0.5 feet (0.15 m) and about 13 feet (4.0 m). For example, the distance between pivot points 126 may be about 1 foot (0.3 m), about 2 feet (0.6 m), about 3 feet (0.9 m), about 4 feet (1.2 m).

The pivot points 126 also need not alternate between the first flange 120 and the second flange 130. Indeed, the pivot points 126 may be located in any number of manners. For example, the pivot points may alternate top/bottom in 2-1-2, 2-2-2, or 1-2-1 configurations.

Angles

Although only 90° bends are depicted in the figures, the predetermined angles into which the beam may be configured are not restrict to 90°. The location and angle of the indentation 190, protuberance 164, cutout 160, and/or locking edge 162 may be arranged so that the indentation 190 is adapted to engage with the cutout 160, protuberance 164, and/or locking edge 162 at a specified angle identified before the beam is subject to bending forces (i.e., a predetermined angle). Indeed, the elements described herein may be configured so that the beam 100 may be bent to about 15°, about 30°, about 45°, about 60°, about 75°, about 90°, about 105°, about 120°, about 135°, about 150°, or about 165°.

Beam Materials

It will be understood that the beam 100 may be constructed from any bendable material such as metals, polymers, or carbon fiber. In an exemplary embodiment, the beam 100 is manufactured from rolled steel.

Beam Dimensions

The height of the beam 100 is between approximately 1 inch (2.54 cm) to approximately 6 inches (15.24 cm). In an exemplary embodiment, the height of the beam 100 may be between approximately 1 inch (2.54 cm) to approximately 1.50 inches (3.81 cm). For example, the height of the beam 100 may be approximately 1.25 inches (3.18 cm).

The combined widths of the first flanges 120 of the beam 100 may be between about 0.25 inches (0.64 cm) and about 1.50 inches (3.81 cm). In a non-limiting embodiment, the combined widths of the first flanges 120 may be between about 0.50 inches (1.27 cm) and about 1.00 inch (2.54 cm). For example, the combined widths of the first flanges 120 may be about 0.56 inches (1.42 cm).

The combined widths of the second flanges 130 of the beam may be between about 0.25 inches (0.64 cm) and about 2.50 inches (6.35 cm). In a non-limiting embodiment, the combined widths of the second flanges 130 may be between about 0.50 inches (1.27 cm) and about 2.00 inch (5.08 cm). For example, the combined widths of the second flanges 130 may be about 1.50 inches (3.81 cm).

In another embodiment, the combined widths of the first flanges 120 are less than or equal to the combined widths of the second flanges 130.

The material gauge from which the beam 100 may be constructed may be between approximately 0.008 inches (0.020 cm) and 0.05 inches (0.127 cm). More preferably, the material gauge may be between approximately 0.010 (0.025 cm) and 0.018 inches (0.046 cm).

Incorporation into a Ceiling System

The disclosed beam 100 may be incorporated into a ceiling system grid framework to assist in the formation of soffits.

In selecting the configuration to form the bend, at the job site, the total vertical and horizontal length of the beam 100 in the framework of a soffit is determined and the beam 100 may be cut to such length. The bend is then made at a selected configuration in the beam 100 that provides the desired bent shape to the beam 100. At each bend, the angle is locked into place using the spring pocket 150 and indentation 190 and, optionally, fasteners passed through the apertures 180. As the configuration remains uncut, the beam 100 remains straight and intact and strong enough to support the drywall.

The bent beam 100 is then suitably supported from a structural ceiling and wall by, for example, hanger wires and angles, along with identical bent beams 100 that form a framework for the drywall which may be secured to the beams 100 by self-tapping screws to finish the ceiling soffit.

Although illustrated and described above with reference to certain specific embodiments and examples, the present invention is nevertheless not intended to be limited to the details shown. Rather, various modifications may be made in the details within the scope and range of equivalents of the claims and without departing from the spirit of the invention. It is expressly intended, for example, that all ranges broadly recited in this document include within their scope all narrower ranges which fall within the broader ranges. It is also expressly intended that the steps of the methods of using the various devices disclosed above are not restricted to any particular order.

What is claimed is:

1. A beam for a suspended ceiling comprising:

a web having a first edge opposite a second edge;

a first flange at the first edge or the second edge extending substantially perpendicularly out from the web;

a web notch beginning in the web and extending through either the first edge or the second edge defining a first side opposite a second side, wherein the first side or the second side contains a spring pocket defining a cutout having a locking edge, and the other of the first side or the second contains a protuberance projecting out from the web in the direction away from the spring pocket;

wherein the protuberance is adapted to engage with the locking edge on the opposite side when the beam is bent to a predetermined angle.

2. The beam of claim 1, wherein the web notch passes through the first edge.

3. The beam of claim 1, wherein the web notch passes through the second edge.

4. The beam of claim 1, wherein two or more web notches alternate between passing through the first edge and the second edge.

5. The beam of claim 4, wherein the web notches are equally spaced.

6. The beam of claim 1, wherein the second side is offset from the first side.

7. The beam of claim 1, wherein the first side or the second side has apertures adapted to accept fasteners.

8. The beam of claim 1, wherein the predetermined angle is about 15°, about 30°, about 45°, about 60°, about 75°, about 90°, about 105°, about 120°, about 135°, about 150°, or about 165°.

9. The beam of claim 1, wherein the first flange has a flange notch.

10. The beam of claim 9, wherein the flange notch is substantially perpendicular to the web notch.

11. The beam of claim 1, wherein the first flange is textured or includes apertures adapted to accept fasteners.

12. The beam of claim 1, wherein the locking edge is substantially straight.

13. The beam of claim 12, wherein the cutout has a side that is substantially straight.

14. The beam of claim 1, wherein the locking edge is curved.

15. The beam of claim 14, wherein the cutout has a side that is curved.

16. A beam for a suspended ceiling comprising:

a web having a first edge opposite a second edge;

a first flange at the first edge or the second edge extending substantially perpendicularly out from the web;

a web notch beginning in the web and extending through either the first edge or the second edge defining a first side opposite a second side, wherein the first side or the second side contains an indentation having a locking edge, the other of the first side or the second side contains a protuberance projecting outward from the web;

wherein the indentation is adapted to engage with the protuberance when the beam is bent to a predetermined angle.

17. The beam of claim 1, wherein the first side or the second side includes a tongue extended outward in a direction away from the spring pocket.

* * * * *